United States Patent [19]

Suga

[11] 4,005,326

[45] Jan. 25, 1977

[54] ELECTRODE MOUNTING IN AN ARC LAMP FOR USE IN LIGHT FASTNESS TESTERS

[76] Inventor: Shigeru Suga, Yoyogi 5-20-2, Shibuya, Tokyo, Japan

[22] Filed: Oct. 31, 1975

[21] Appl. No.: 627,879

[52] U.S. Cl. ..... 313/357; 313/238; 313/267; 13/15; 13/16; 314/51; 314/101; 314/113

[51] Int. Cl.[2] ..... H01J 1/00; H01J 17/04; H01J 19/00

[58] Field of Search ..... 313/357, 238, 267; 13/15, 16; 314/51, 52, 101, 102, 113

[56] References Cited

UNITED STATES PATENTS

| | | | |
|---|---|---|---|
| 824,153 | 6/1906 | Seward | 313/238 X |
| 1,238,277 | 8/1917 | Dinsmoor | 313/267 X |
| 2,151,194 | 3/1939 | Desormeaux | 313/267 X |
| 2,286,755 | 6/1942 | Morton et al. | 313/238 |
| 2,438,803 | 3/1948 | Graham | 313/267 X |
| 2,449,341 | 9/1948 | Tanson | 313/357 X |
| 2,450,477 | 10/1948 | Huff | 313/267 X |
| 3,727,095 | 4/1973 | Hesselmann | 313/357 |

*Primary Examiner*—Saxfield Chatmon, Jr.
*Attorney, Agent, or Firm*—Wenderoth, Lind & Ponack

[57] ABSTRACT

A carbon arc lamp for use in a light fastness tester and other similar testers, and having a metal rod extending from a carbon electrode mounting part in the upper part of the lamp down to a point just below an upper metal plate. A portion of the rod is engaged by a ring clutch which is connected to an automatic feed control for the carbon electrode. The lower end of the metal rod has the upper end of the carbon electrode mounted thereon by a threaded connection.

3 Claims, 6 Drawing Figures

ELECTRODE MOUNTING IN AN ARC LAMP FOR USE IN LIGHT FASTNESS TESTERS

The present invention relates to an arc lamp for use in a light-fastness tester or like apparatus, and which enables easy attaching and detaching of a carbon electrode thereto for replacement of the electrode, and which further carries out smooth up-and-down movement of the carbon electrode.

BACKGROUND OF THE INVENTION AND PRIOR ART

Conventional arc lamps of this type, in general, have a hole through a metal plate positioned in the upper part of an arcing chamber defined by the metal plate and a glass globe, and an upper carbon electrode extends through said hole. The upper carbon electrode is held by a holder above the metal plate, and the upper carbon electrode holder moves up and down along guide rods provided on the right and left sides thereof. The upper electrode passes through a ring clutch which in turn is actuated by an electromagnetic control device which is connected with said ring clutch in order to control the up and down movement of the upper carbon electrode. In such prior art devices, the upper carbon electrode must be electrically insulated from the metal plate where it passes through the hole.

A lower carbon electrode is held by a lower carbon electrode mounting which is attached to a rod suspended from said metal plate. The carbon electrodes are replaced by detaching the globe, and for replacing the upper carbon electrode, the electrode is inserted through a hole in the lower carbon-electrode holder, passed through the metal plate and a double ring of the clutch, and then is fastened to the upper carbon electrode holder.

While arcing is occurring in the lamp, the lower carbon electrode remains stationary, but the upper carbon electrode is controlled in its up and down movement by the control device which operates in accordance with the arcing current or voltage. The ring clutch which is actuated by said control device has a double ring construction, one side of the upper ring being fastened by a hinge to the corresponding side of the lower ring, so that when the other side of the upper ring is pulled up, the edge of the upper ring will bite into the carbon electrode, and upon further upward movement of the ring clutch, the carbon rod will be pulled up. To lower the carbon electrode, the upper ring biting into the carbon electrode is lowered, so that the carbon electrode can slide down through the two rings of the clutch, and the downward movement is stopped at an appropriate position by pulling up the said other side of the upper ring.

A lot of carbon rods are required for extended periods of testing, as the arc discharged during a day consumes a whole carbon rod. It is also necessary that the carbon rod have a uniform diameter and be free of bends, and have a rugged surface. However, it is technically difficult and expensive to make carbon rods having a uniform diameter and uniform surface conditions. If the diameter is not uniform, the ring does not completely bite into the carbon rod and cannot be moved up-and-down smoothly, giving rise to frequent short-circuiting and extinction of the arc. Therefore, it has been customary to grind the edge of the rings of the ring clutch. But even if the edge of the rings on the ring clutch are ground, variations in the diameter of the carbon rod or excessive bending of carbon rod interrupts the smooth up-and-down movement, often resulting in sliding down of the carbon rod. The ring clutch is also disposed at a position which is hard to see from outside the lamp. Therefore, it is very hard, after the carbon rod is passed upwardly through the metal plate during replacement of the rod, to make sure whether the carbon rod is running through the ring clutch. In particular, since hot air heated by the metal plate is directly emitted from the testing apparatus, the lamps which are enclosed make it less feasible to make sure whether the carbon rod has been passed through the ring clutch properly. Thus, the carbon rod has often not been properly passed through the ring clutch, resulting in unexpected accidents.

OBJECT AND BRIEF SUMMARY OF THE INVENTION

It is therefore the object of the present invention to remove the aforementioned drawbacks inherent in the prior art arc lamps.

BRIEF DESCRIPTION OF THE DRAWINGS

The invention will now be described in connection with the accompanying drawings, in which.

DETAILED DESCRIPTION OF THE INVENTION

Figure 1:
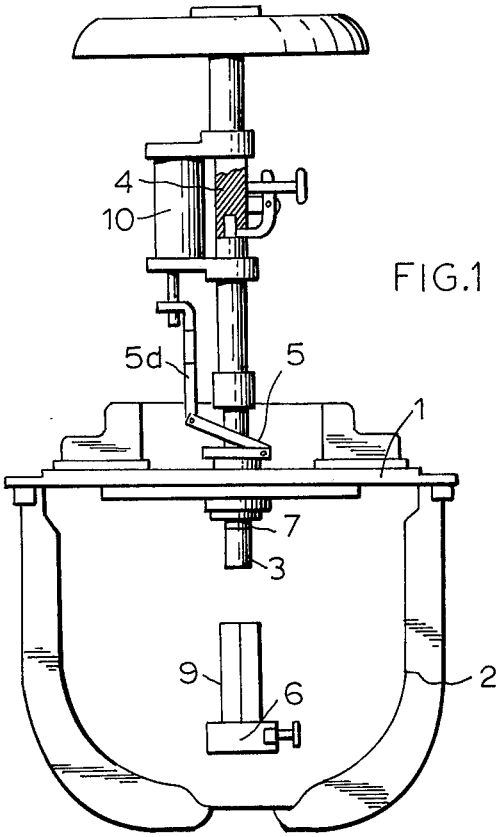
FIG. 1 is a schematic view showing the major parts of the carbon arc lamp according to the present invention.
Figure 2A:
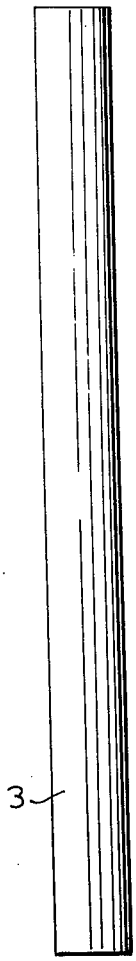
(PRIOR ART) FIG.2A
FIGS. 2*a* and 2*b* are elevation views, FIG. 2*b* being partly in section, of an upper carbon electrode according to the prior art and according to the present invention, respectively.
Figure 2B:
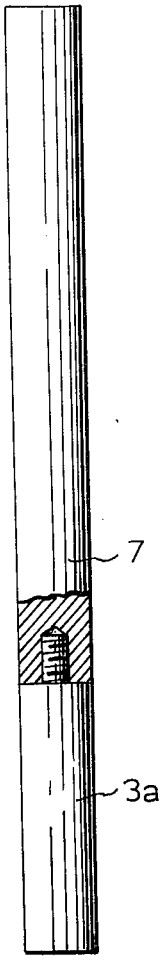
Figure 3:
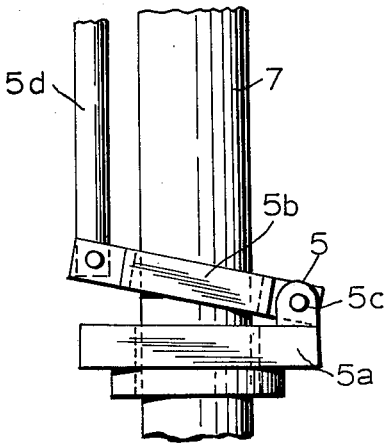
FIG. 3 is an enlarged elevation view of a ring clutch.
Figure 4A:
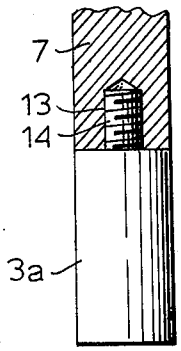
FIGS. 4*a* and 4*b* are elevation views, partly in section, of embodiments of the metal rod and the upper carbon electrode according to the present invention.
Figure 4B:
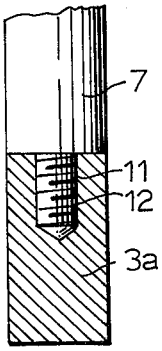

According to the arc lamp of the present invention, as shown in FIG. 1, the lower carbon electrode 9 can be mounted in the lower electrode mounting 6 in the same manner as in the prior art lamp, but the construction of the mounting for the upper carbon electrode is different from the prior art. A cylindrical metal rod 7, which is almost as long as the carbon electrode 3 in the prior art lamp, as shown in FIG. 2*a*, is inserted through an upper metal plate 1 and is electrically insulated from said metal plate 1. The metal rod passes through the lower and upper rings 5*a* and 5*b* of the ring clutch 5 above the metal plate 1, and has the upper end slidably fitted into a recess in an upper electrode mounting 4. The ring clutch 5 is the same form as the prior art ring clutches, the upper ring 5*b* being pivoted at 5*c* to lever ring 5*a* on one side thereof and the other side of the upper ring being connected by a connecting rod 5*d* to a control device 10 such as a solenoid.

The lower end of said metal rod 7 has thread means at the lower end thereof and an upper carbon electrode 3*a* is threadedly connected thereto. The rod 7 can have a threaded stud 11 thereon and the electrode 3*a* can have an internally threaded hole 12 into which said stud 11 of the metal rod 7 is screwed. Alternatively, the rod 7 can have the threaded hole, as at 13 and the tip of the electrode 3*a* can have a threaded stud 14 threaded into the hole 13.

With this structure, there is no possibility that the carbon electrode will slide down, and there is no need of inspecting the carbon electrode for straightness and an irregular surface during testing. The ring clutch is ground only once, i.e. at the time of its manufacturing.

The carbon electrode can be replaced simply by removing the globe. The upper carbon electrode is screwed into the lower part of the metal rod 7, and therefore the upper carbon electrode can be replaced simply at the same time as the lower carbon electrode, since it is unnecessary to slide the long upper electrode 3 through the plate 1 and the rings of clutch 5 into the recess in mounting 4. All that is necessary is to unscrew the electrode 3*a* from the lower end of rod 7 and replace it.

The improvement attained by the present invention can be summarized as follows:

1. There is no need to finish the surface of the upper carbon electrode carefully, and there is no need to define the manufacturing tolerance of the diameter carefully. The carbon electrode can be made inexpensively.

2. The carbon electrode can be replaced by simply removing the globe and unscrewing the worn out electrode and screwing on a new one. Replacement is thus very easy.

3. There is no way that the carbon electrode can be passed outside the ring clutch, since the rod 7 is always in the ring clutch.

4. The carbon electrode never falls down due to the failure of the ring clutch to bite into the carbon electrode, since the ring clutch bites into rod 7 instead.

What is claimed is:

1. In an arc lamp for use in light fastness testers and the like and having an upper plate and a globe detachably mounted on the lower side thereof, a lower electrode holder in said globe and depending from said plate, and an upper electrode holder above said plate having a recess for receiving the end of a cylindrical electrode therein, the improvement comprising a ring clutch between the upper electrode holder and the plate through which the upper electrode is intended to pass, a control means connected to said ring clutch for actuating said ring clutch to engage the electrode extending therethrough for moving the electrode up and down, a cylindrical metal rod having the same diameter as an electrode and extending into the recess in the upper electrode holder and extending through the ring clutch and through said upper plate into the space within said globe and opposed to said lower electrode holder, and a cylindrical carbon electrode on the lower end of said metal rod, and threaded connecting means threadedly connecting said metal rod and said electrode.

2. The improvement as claimed in claim 1 in which the threaded connecting means comprises a male threaded bolt on the end of said metal rod and a female threaded bore in the end of the electrode and on the axis of the electrode.

3. The improvement as claimed in claim 1 in which the threaded connecting means comprises a female threaded bore in the end of the metal rod and a male threaded end portion on the electrode.

* * * * *